US006325501B2

(12) United States Patent
Kuwabara et al.

(10) Patent No.: US 6,325,501 B2
(45) Date of Patent: Dec. 4, 2001

(54) INK-JET PRINTING CLOTH, PRINTING PROCESS USING THE SAME AND PRINT OBTAINED BY THE PROCESS

(75) Inventors: Nobuyuki Kuwabara, Kawasaki; Yuji Akiyama, Yokohama; Miyuki Fujita; Yuko Nishioka, both of Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/797,960

(22) Filed: Mar. 5, 2001

Related U.S. Application Data

(63) Continuation of application No. 09/015,050, filed on Jan. 28, 1998, now abandoned, which is a continuation of application No. 08/420,769, filed on Apr. 12, 1995, now abandoned.

(30) Foreign Application Priority Data

Apr. 15, 1994 (JP) ..... 6-77013
Feb. 16, 1995 (JP) ..... 7-27927

(51) Int. Cl.[7] ..... B41J 2/17; B41J 3/407
(52) U.S. Cl. ..... 347/96; 347/106
(58) Field of Search ..... 347/96, 98, 100, 347/105, 106

(56) References Cited

U.S. PATENT DOCUMENTS

| | | | |
|---|---|---|---|
| 4,615,709 | 10/1986 | Nakao | 8/599 |
| 4,712,290 | 12/1987 | Lindsey | 28/178 |
| 4,786,288 | 11/1988 | Handa et al. | 8/495 |
| 5,126,010 | 6/1992 | Kobayashi et al. | 162/135 |
| 5,266,383 | 11/1993 | Sakaki et al. | 428/195 |
| 5,338,597 | 8/1994 | Kurabayashi et al. | 428/195 |
| 5,348,557 | 9/1994 | von der Eltz et al. | 8/188 |
| 6,022,383 | 2/2000 | Kuwabara et al. | 8/436 |
| 6,188,850 | 2/2001 | Sakaki et al. | 399/1 |

FOREIGN PATENT DOCUMENTS

| | | |
|---|---|---|
| 0 177 111 A3 | 4/1986 | (EP) . |
| 0 590 397 A1 | 4/1994 | (EP) . |
| 0 624 682 A1 | 11/1994 | (EP) . |
| 0 631 006 A1 | 12/1994 | (EP) . |

OTHER PUBLICATIONS

Database WPI, Derwent Publications Ltd., Class A28, AN 93–224708, (with respect to JP–A–5 148 775 of Jun. 15, 1993).

Database WPI, Derwent Publications Ltd., Class A87, AN 86–294666, (with respect to JP–A–61 215 787 of Sep. 25, 1986).

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink-jet printing process using an ink containing a dye having an ionicity. The process includes the steps of: providing a cloth containing (a) a substance having an ionicity opposite to the ionicity of the dye and a molecular weight of from 100 to 700, or a nonionic surfactant having a molecular weight of from 100 to 700 and an H.L.B. of from 7 to 15, and (b) a polymeric substance having an ionicity opposite to the ionicity of the dye and a molecular weight of from 2,000 to 200,000; printing on the cloth with the ink; washing the cloth after printing; and drying the cloth.

32 Claims, 4 Drawing Sheets

INK-JET PRINTING CLOTH, PRINTING PROCESS USING THE SAME AND PRINT OBTAINED BY THE PROCESS

This is a continuation application of application Ser. No. 09/015,050, filed Jan. 28, 1998, which is a continuation application of application Ser. No. 08/420,769, filed Apr. 12, 1995, both now abandoned.

BACKGROUND OF THE INVENTION

1. Field of the Invention

The present invention relates to a printing cloth suitable for use in conducting printing by an ink-jet system, a printing process using this cloth, and a print obtained by this process. In particular, this invention relates to a printing cloth on which printing can be easily conducted by means of a general-purpose ink-jet printer generally used for recording media such as paper, a printing process using this cloth and printed products such as patchwork and ditty bags obtained by this process.

2. Related Background Art

In recent years, textile printing apparatus making use of an ink-jet technique have been put to practical use, and printed cloths with high definition have come to be produced by a simple process. In such a printing process, however, a great amount of dyes is unvaryingly washed out by a post treatment as before. Therefore, these apparatus are all industrial printing apparatus. On the other hand, ink-jet printers generally used for printing media such as paper are commonly spread. For the above-described reason, it is substantially difficult under the circumstances for users to easily conduct printing with high definition as they please using such a printer.

In the industrial printing process, a cloth after printing is subjected to a treatment called steaming, in which the printed cloth is exposed to high-temperature steam, thereby more accelerating the bonding between dye molecules and molecules constituting fibers in the cloth. The thus-treated cloth is then washed with water, thereby washing out unreacted dye molecules to obtain a print. The dyes washed out at last generally amount to from 20% to 50% of the dyes used upon the printing. In order to maintain sufficient color depth as a print, therefore, dyes in an additional amount corresponding to the dyes washed out must be provided in advance, and so great amounts of dyes are generally required in the industrial printing process. Such washing out of dyes also apply to textile printing apparatus making good use of an ink-jet system.

Small-sized and low-priced color ink-jet printers have recently come to spread, and there has also been a demand for easily printing on cloth using such a printer. However, in such an ink-jet printer, an ink used therein generally contains a dye only in an amount limited to several percent for the purpose of preventing reduction in ejection efficiency from a minute nozzle in a printing head and ejection failure mainly caused by the drying of the ink in an orifice of the nozzle. Therefore, it is difficult to apply a great amount of the dye to the cloth if a general-purpose ink-jet printer is used as a simple texture-printing apparatus meeting the above demand. It is accordingly necessary to devise so as to scarcely wash out the dye applied to the cloth upon subsequent water washing. This makes it possible to avoid an increase in running cost due to the increased consumption of the dye and a problem of contaminated waste water in general homes, and is hence said to be more important.

In addition, since the above-described steaming treatment in the industrial textile printing can be scarcely performed in general homes, this steaming treatment also becomes a great problem.

In addition to these problems, there remains a problem that since a feeding mechanism of a medium in the general-purpose ink-jet printer is constructed in consideration of printing on generally used printing media such as paper and plastic films typified by OHP sheets, cloth and the like, which are soft, or free of so-called "stiffness" as compared to these media, are hard to feed.

In order to solve the above-mentioned problems, the present assignee has proposed a printing cloth which does not cause washing out of dyes, and is feedable in general-purpose ink-jet printers. However, there are various kinds of materials or the ways to weave on cloths. Therefore, a further improvement has been required if one has intended to bring out reliable and good printed image properties on these various kinds of cloths. In the above proposal, it is conducted to aggregate a dye applied on a cloth to fix the dye by a method in which printing is conducted with an ink containing an anionic dye on a cationized cloth, or a method in which a substance having an ionicity different from that of a dye in an ink, i.e., a dye-fixing agent, is contained in a cloth in advance. In these methods, however, there are cases where feathering may increase, though it is a little, according to the pattern of a printed image when printing is performed in an environment of high humidity on a printing medium composed of a fabric such as a cloth and having interstices between weaving yarns thereof, and where washing out of dyes upon water washing may somewhat occur. These problems are regarded as more important when more bright printed images is intended to provide on various kinds of cloth using an ink-jet technique.

In general, a polymeric substance has been used as the dye-fixing agent. This compound serves to facilitate the fixing of the dye by associating this polymeric substance itself with the dye to aggregate them. Therefore, it is effective to make the size of the aggregate greater from the viewpoint of the fixing of the dye. It is hence effective to use a polymeric substance having a higher molecular weight. However, if the molecular weight of the polymeric substance as the dye-fixing agent is too great, there is a tendency for the polymeric substance to retain on the surface of the cloth by the impregnation method conventionally performed due to its poor penetrability when applied to the cloth by itself. If printing is performed on such a cloth, the dye becomes easy to undergo aggregation. Therefore, image quality and fastness to water, i.e. water fastness are adversely affected when a pattern using a great amount of an ink is printed, or printing is performed at a high humidity. More specifically, there occur disadvantages such that a) colorability becomes poor, and b) the penetration of the ink in a thickness direction of the cloth is prevented, and bleeding on the surface of the cloth becomes marked at potions of the cloth, to which a great amount of the ink is applied. Besides, there are exerted adverse influences such that c) the penetration of the ink into the cloth is easy to become uneven, and so the evenness of a solid printed area is poor, and d) sufficient dyeing is not achieved due to the insufficient penetration, and so water fastness becomes low. Since there is a possibility that such conditions may occur, the kinds of usable polymeric substances are limited, and so a range of application of cloth may become narrow. Therefore, the present inventors have aimed at achieving higher image quality on various kinds of cloth.

SUMMARY OF THE INVENTION

It is therefore a principal object of the present invention to provide a printing technique capable of applying to a nonindustrial field, to say nothing of an industrial field, and to an ink-jet printing cloth which can provide bright images and has a very high color-fixing effect without rendering dyes applied futile, a simple printing process capable of providing bright images by using this cloth, and a fast print undergoing no color fading even when it is washed.

Another object of the present invention is to provide a ink-jet printing cloth which permits the application of high-definition color representation according to an ink-jet textile printing process using an ink-jet technique to not only an industrial field, but also a field of printing for pleasure in general homes, thereby permitting the production of prints with the same sense as in the case of the conventional printing on paper.

The above objects can be achieved by the present invention described below.

According to the first aspect of the present invention, there is thus provided an ink-jet printing cloth suitable for use in printing with inks each containing a dye having an ionicity, wherein a substance not having the same ionicity as that of the dye and having a molecular weight lower than 1,000, and a polymeric substance having an ionicity opposite to that of the dye and a molecular weight higher than 2,000 are applied to the cloth.

According to the first aspect of the present invention there is also provided an ink-jet printing process, comprising printing on the ink-jet printing cloth described above with inks each containing a dye having an ionicity in accordance with an ink-jet system, washing the ink-jet printing cloth after the printing and then drying the cloth.

According to the first aspect of the present invention there is further provided a printed cloth produced in accordance with the ink-jet printing process described above.

According to the second aspect of the present invention, there is still further provided an ink-jet printing cloth suitable for use in printing with inks each containing a dye having an ionicity, wherein a substance not having the same ionicity as that of the dye and having a molecular weight lower than 1,000, a polymeric substance having an ionicity opposite to that of the dye and a molecular weight higher than 2,000, and a stiffening agent, which is not chemically and physically bonded to the dye, the substance having a molecular weight lower than 1,000, and the polymeric substance, are applied to the cloth.

According to the second aspect of the present invention there is yet still further provided an ink-jet printing process, comprising printing on the ink-jet printing cloth described above with inks each containing a dye having an ionicity in accordance with an ink-jet system, washing the ink-jet printing cloth after the printing to remove the stiffening agent from the cloth and then drying the cloth.

According to the second aspect of the present invention there is yet still further provided a printed cloth produced in accordance with the ink-jet printing process described above.

DESCRIPTION OF THE PREFERRED EMBODIMENTS

Figure 1:
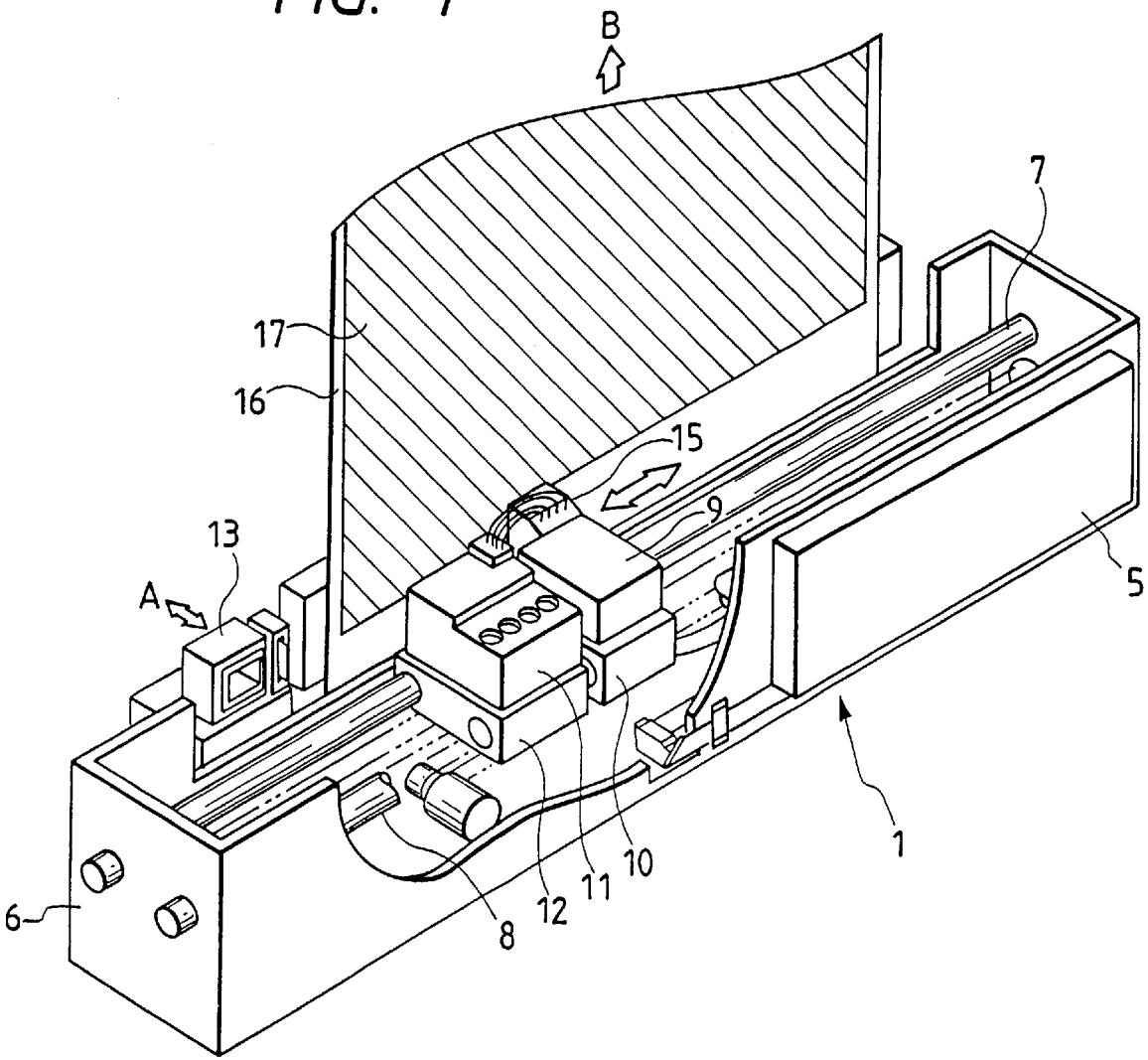
FIG. 1 illustrates the principal constitution of an ink-jet printing apparatus according to an embodiment of the present invention.

The first aspect of the present invention has been made by studying the course of penetration after an ink ejected by an ink-jet system reaches a cloth from all angles. Dyes to be contained in an ink include various kinds of dyes. Many of them have an ionicity. Ionic bonding based on this ionicity of the dye greatly contributes to the coloring of the cloth. Namely, the dye is bonded by ionic bond to individual molecules of fibers constituting the cloth. Accordingly, as a dye-fixing agent caused to exist in the cloth, there have heretofore been often used substances having an ionicity opposite to that of the dye in the ink, in particular, polymeric substances. As a result that search for higher image quality and improvement in color yield has been made for cloths to be printed, it has been found that when a substance not having the same ionicity as that of the dye and having a molecular weight lower than 1,000 is applied into a cloth in addition to the above-described dye-fixing agent, a very good effect is exhibited. More specifically, the existence of this substance has made it possible to facilitate a penetrating action, whereby the polymeric substance fixing the dye has been allowed to distribute up to a deeper interior of the cloth, and an ink printed has been caused to more penetrate in the interior of the cloth to achieve high image quality and improve color yield. Here, the substance having a molecular weight lower than 1,000 has an action to facilitate penetration, and must not cause evil effects such that it repels the ionic dye. The molecular weight is preferably within a range of from 100 to 700. If the molecular weight is outside this range, it occurs often that the above penetrating action is not sufficiently facilitated. Therefore, it must have an ionicity different from that of the dye. The substance not having the same ionicity as that of the dye and having a molecular weight lower than 1,000 hereinafter be referred to as the "penetration-facilitating substance" for the brevity's sake of description.

When droplets of an ink ejected by an ink-jet apparatus reach such a cloth, the ink first penetrates in the interior of fibers by the action of the penetration-facilitating substance, and the dye contained in the ink is aggregated by the polymeric substance contained in the cloth. The aggregates thus formed are high in viscosity and hence difficult to move together with a solvent of the ink. Therefore, even if adjacent dots are formed with inks of different colors, respectively, like image formation by full-color printing, they are not mixed with each other and the occurrence of unnecessary bleeding can hence be prevented. In addition, since the dye becomes insoluble in water by the aggregation, it is not washed out by repeated water washing after completion of the printing. Accordingly, there are obtained images which are first improved in water fastness and at the same time, sufficient and even in the penetration of the ink, free of marked aggregation of the dye on the surface of the cloth and hence bright in color, and good in evenness of solid printed areas.

In such an action, if the penetration-facilitating substance has an ionicity opposite to that of the dye, it is ionically bonded to the dye contained in the ink at the same time as the ink droplets penetrate into the cloth. Therefore, the movement of the dye can be made difficult before the dye is aggregated by the action of the polymeric substance, thereby acting more effectively on the formation of high-quality images.

These constituents will hereinafter be described specifically.

In the present invention, ionic dyes, i.e., anionic or cationic dyes are used as dyes. Specifically, the anionic dyes include acid dyes, direct dyes, reactive dyes and the like, while the cationic dyes include basic dyes and the like. In particular, the anionic dyes are preferably used as coloring materials for ink-jet. For this reason, description will be advanced as to the case where the anionic dyes are used for the brevity's sake of subsequent description. Therefore, the term "the same ionicity as that the dye" means an anionic nature, while the term "the ionicity opposite to that of the dye" means a cationic nature.

The penetration-facilitating substance will then be described. As described above, this serves to enhance the penetrability of the polymeric substance having as its main object the fixing of the dye and the ink. In order to have these two functions have at the same time, a substance not having the same ionicity as that of the dye, namely, cationic substances or nonionic surfactants are effective for the anionic dyes. Here, surfactants generally have a penetrating action. Accordingly, this is effective for the purpose of the present invention.

As examples of these cationic substances and nonionic surfactants, which are easy to exhibit the above-described functions, may be mentioned the following substances. First, preferable examples of the cationic substances include compounds of the quaternary ammonium salt type, specifically, lauryltrimethylammonium chloride, lauryldimethylbenzylammonium chloride, benzyltributylammonium chloride, benzalkonium chloride and the like; compounds of the pyridinium salt type, specifically, cetyl pyridinium chloride, cetyl pyridinium bromide and the like; cationic compounds of the imidazoline type, specifically, 2-heptadecenyl hydroxyethylimidazoline and the like; adducts of higher alkylamines with ethylene oxide, specifically, dihydroxyethylstearylamine and the like.

Further, amphoteric surfactants exhibiting a cationic nature in a certain pH range may also be used. Specific examples thereof include amphoteric surfactants of the amino acid type; compounds of the R—NH—$CH_2$—$CH_2$—COOH type; compounds of the betaine, specifically, carboxylic acid amphoteric surfactants such as stearyldimethylbetaine and lauryldihydroxyethylbetaine; and besides, amphoteric surfactants of the sulfuric ester, sulfonic acid and phosphoric ester types, and the like. In the case where these amphoteric surfactants are used, it is necessary to control so as to show a pH not higher than an isoelectric point when mixed with an ink on a cloth.

Specific examples of the nonionic surfactants include adducts of higher alcohols with ethylene oxide, adducts of alkylphenols with ethylene oxide, adducts of fatty acids with ethylene oxide, adducts of polyhydric alcohol fatty acid esters with ethylene oxide, adducts of fats and oils with ethylene oxide, adducts of polypropylene glycol with ethylene oxide, fatty acid esters of glycerol, fatty acid esters of pentaerythritol, fatty acid esters of sorbitol and sorbitan, fatty acid esters of sucrose and alkyl ethers of polyhydric alcohols. In order to cause the penetrability to more effectively exhibit, their H.L.B. may preferably be not lower than 7, but not higher than 15.

The polymeric substance useful in the practice of the present invention will then be described. As described above, this substance functions so as to associate with a dye to form aggregates, and as a result to make it difficult to further move the dye in interstices between fibers constituting a cloth, whereby only a liquid portion formed by solid-liquid separation penetrates into other fiber portions of the cloth, and so the quality, bleeding tendency and color fixing of a printed image are improved. Therefore, the polymeric substance is required to have an ionicity opposite to that of the dye. Namely, if the dye is anionic, a cationic polymer is used. Upon using this polymeric substance, its molecular weight is preferably not lower than 2,000, more preferably not lower than 2,000, but not higher than 200,000. Some evils may arise occasionally such that, if the molecular weight is lower than 2,000, it is insufficient in fixing the dye, and if the molecular weight exceeds 200,000, the polymeric substance becomes difficult to penetrate into the cloth, to impede the adhesion of the dye upon printing, thereby lowering the color depth of the resulting image. Incidentally, the molecular weight of the polymeric substance is defined as an average molecular weight by weight.

Specific examples of cationic polymeric substances usable in the present invention include water-soluble cationic polymers such as polyallylamine salts, polyallyl sulfone, polydimethyldiallylammonium chloride, polyvinylamine salts and chitosan acetate. However, the cationic polymeric substances are not limited to these compounds. Those generally exhibiting a nonionic nature, but added with a cationic group to a part thereof may also be used. As specific examples thereof, may be mentioned copolymers of vinylpyrrolidone and a quaternary salt of an aminoalkyl acrylate, and copolymers of acrylamide and a quaternary salt of aminomethylacrylamide.

Cloths used in the present invention are not limited to special cloths. Cloths commonly used in various applications can be utilized. It is further preferable to use cloths cationized by the conventional methods. Examples of cloths usable in the present invention include cloths made of natural fibers such as cotton, wool and silk and cloths composed of synthetic fibers such as nylon and rayon.

The application of the above-described penetration-facilitating substance and polymeric substance to a cloth can be performed by preparing a solution from these materials to provide a treating solution optionally containing other additives, and impregnating or coating the cloth with the treating solution by any known process, for example, a mangle, heat setter, roll coater, blade coater, air knife coater, gate roll coater, bar coater, spray coating, slit coating, gravure coater or curtain coater process. Thereafter, the cloth thus treated is dried by means of a circulating hot air oven, heated drum or the like to obtain a treated cloth. It is also effective to smooth the treated cloth after the drying by a hot press or the like, as needed.

The amount in total of these penetration-facilitating substance and polymeric substance to be applied to the cloth is preferably within a range of from 0.05 $g/m^2$ to 20 $g/m^2$, more preferably from 1 $g/m^2$ to 10 $g/m^2$ based on the unit area of the cloth. If the amount is less than 0.05 $g/m^2$, the above-described effects of both components cannot be fully achieved. On the other hand, if the amount is more than 20 $g/m^2$, the treating solution becomes a high viscosity, and so these components do not fully penetrate into the cloth, and the components hence are dense near the surface of the cloth after drying to give the so-called film-forming effect. For this reason, the absorptiveness of an ink in fibers constituting the cloth is deteriorated, and so coloring after printing is deteriorated, the ink remains in plenty on the surface of the cloth to markedly cause bleeding on the contrary, and dyeing property of the ink on the cloth is deteriorated.

The compounding ratio of both substance varies in range of application according to which of the cationic substance and the nonionic surfactant to select as the penetration-facilitating substance. In the case where the penetration-facilitating substance is the cationic substance, a weight ratio of the cationic substance to the polymeric substance is preferably within a range of from 1:100 to 1:1, more preferably from 1:10 to 1:1. In the case where the penetration-facilitating substance is the nonionic surfactant, a weight ratio of the nonionic substance to the polymeric substance is preferably within a range of from 1:10 to 10:1, more preferably from 1:10 to 1:1.

In each case, if the proportion of the penetration-facilitating substance is shifted to a proportion relatively lower than the above range, the penetration-facilitating action into the cloth on the polymeric substance and the ink becomes insufficient, and so the deterioration of the resulting image due to bleeding tends to occur. On the other hand, if the proportion of the penetration-facilitating substance is shifted to a proportion relatively higher than the above range, the color-fixing effect by the polymeric substance tends to be lessened.

According to other embodiments of the first aspect of the present invention, there are provided an ink-jet printing process comprising printing on the ink-jet printing cloth according to the first aspect of the present invention as described above with inks each having an ionicity in accordance with an ink-jet system, and then washing the ink-jet printing cloth, and a print produced in accordance with this ink-jet printing process.

After ink-jet printing is performed on the above-described ink-jet printing cloth, and the cloth is air-dried, the dyes are fixed and dyed within the cloth by the effect of the cationic polymeric substance. Therefore, unreacted penetration-facilitating substance and cationic polymeric substance can be washed out by washing.

In order to more facilitate the fixing of the inks to the cloth after the printing by an ink-jet printer, it is effective to apply hot air to the cloth, pass the cloth through on a fixing heater or subject the cloth to a heat treatment by a household iron. No particular limitation is imposed on the way to wash upon washing, and any method such as washing by a household washing machine or scrubbing with hands may be used. Upon the washing, no limitation is imposed on the temperature of water. However, the temperature of water is preferably higher in that the degree of dyeing is enhanced.

Although the first aspect of the invention has been specifically described, the second aspect of the present invention will then be described, wherein a stiffening agent, which is not chemically and physically bonded to the dyes, the penetration-facilitating substance and the polymeric substance, is further applied to the ink-jet printing cloth. The application of the stiffening agent to the cloth to stiffen the cloth is to impart "stiffness" to the cloth. This is intended to facilitate the feeding of the cloth to a feeding means in a general-purpose ink-jet printer, and further to permit the automatic feeding. This treatment makes is possible to change a generally soft cloth to a state easy to handle. Therefore, this makes it possible to more simply conduct printing in general homes. In the case where printing is performed in general homes, an environment about the printer are more various than that in industrial printing. It is hence an effective means to impart "stiffness" to the cloth itself by the stiffening agent-imparting treatment so as to make its handling easy. Such a means is a form of invention.

High-molecular compounds generally used as sizing agents may be applied to the stiffening agents. Examples of the materials usable as the sizing agent include carboxymethyl cellulose, polyvinyl alcohol, polyacrylates, polyacrylamide, starch, dextrin, guar gum, British gum, tragacanth gum, locust bean gum and the like. These compounds are all soluble in water and hence easy to handle.

Among these, that not chemically and physically bonded to none of the dyes, penetration-facilitating substances and polymeric substances is selected. As described above, these substances act by using ionic bonding. Therefore, the stiffening agent is preferably nonionic from the viewpoint of undergoing no ionic bonding to the anionic dyes and the cationic polymeric substances. However, it is not necessary for the stiffening agent to strictly have a nonionic nature according to the degree of ionization of the individual substances to be applied. Therefore, those having somewhat ionicity may be used so far as they do not undergo ionic bonding. In particular, the stiffening agent is required not to undergo ionic bonding to the dyes. Accordingly, it is only necessary to select those meeting these conditions from the above-mentioned sizing agents and use them either singly or in any combination thereof.

As a method of applying these stiffening agents, there may be used a process in which a solution is first prepared from the stiffening agents to dip the whole cloth into the solution, and the cloth is then squeezed by a mangle, thereby impregnating the cloth with the stiffening agents. It is also possible to use a process in which the solution is applied to a cloth by the conventionally-known coating process, for example, a bar coater process, roll coater process, applicator process or screen printing, and the cloth is then dried, or a process in which a film formed of the sizing agent is laminated on a cloth by adhesion or contact bonding.

Since the sizing agent has high hygroscopicity, ink is easy to penetrate even if the sizing agent remains on the printing surface of the cloth, whereby the ink can be penetrated into the interior of the cloth. Accordingly, the sizing agent may be applied to the cloth by either lamination or impregnation. Besides, in order to control the degree of stiffness and surface profile of the cloth, oils, waxes, high-molecular compounds, salts of inorganic compounds, fillers, antiseptics and/or the like may be suitably mixed in the solution for the stiffening treatment in addition to the sizing agents according to the kinds of the cloth and inks to be used.

In addition, since the ionicity of the stiffening agent is limited as described above, the cloth holds dye well at portions of the resulting printed images owing to no bonding of the dyes to the stiffening agent even when the cloth is washed after printing to wash the stiffening agent out of the cloth.

The order of the treatments for applying the stiffening agent, and the penetration-facilitating substance and polymeric substance to the cloth may basically be in any way so far as the above-described ionic requirements are satisfied. The application forms thereof may be various.

Namely, the application forms include:

1) a method in which the penetration-facilitating substance, polymeric substance and stiffening agent are impregnated the cloth in a mixed state;

2) a method in which the applications of the penetration-facilitating substance and polymeric substance, and the stiffening agent to the cloth are conducted in that order; and 3) a method in which the penetration-facilitating substance and polymeric substance, and the stiffening agent are respectively applied to the opposite sides of the cloth.

These application forms have the following respective features.

First, the method in which the respective solutions of the penetration-facilitating substance and polymeric substance, and the stiffening agent are mixed with each other to treat the cloth at the same time is useful in that it is most common and a simple process. By the way, if the ionicities of the respective agents are controlled as described above, neither aggregation in the solution nor deterioration in properties inherent in the materials in the respective solutions occurs upon the mixing of the respective solutions. In particular, it is more effective if the stiffening agent is nonionic.

The method in which the penetration-facilitating substance and polymeric substance, and the stiffening agent are applied in that order will then be described. This method is effective if the cloth to be treated is thin. If the cloth is thin, sufficient stiffness is hard to be obtained unless a great amount of the stiffening agent is used. If the stiffening agent exists in the great amount in the cloth as described above, the penetration of inks into the resulting printing medium may possibly be impeded. The present inventors have found that in order to avoid this possibility, it is useful to treat the cloth with the penetration-facilitating substance and polymeric substance, and then apply the stiffening agent in a relatively small amount. Namely, in this form, the stiffening agent tends to be dense near the surface of the cloth, and so the apparent stiffness of the cloth is easy to be heightened. Therefore, sufficient stiffness is imparted even by a relatively small amount of the stiffening agent. For this reason, inks ejected on the printing medium by an ink-jet printing system can be fully penetrated into the interior of the printing medium, and the contact of the dyes with the penetration-facilitating substance and polymeric substance is not inhibited by the stiffening agent.

The method in which the penetration-facilitating substance and polymeric substance, and the stiffening agent are respectively applied to the opposite sides of the cloth is intended to more effectively develop the respective functions of the penetration-facilitating substance and polymeric substance, and the stiffening agent. In order to increase the existing probability of the penetration-facilitating substance and polymeric substance on a surface on which ink-jet printing is conducted, the treatment with the penetration-facilitating substance and polymeric substance is performed on the printing surface, and the treatment with the stiffening agent is conducted on the surface opposite to the printing surface. In this case, no particular limitation is imposed on the priority of the surfaces to be treated. In order to make the effects of the penetration-facilitating substance and polymeric substance more effective, it is however preferable that the treatment of the printing surface with the penetration-facilitating substance and polymeric substance be prior to the treatment with the stiffening agent.

In each of these treating processes, a drying process is required after the application of the solutions because the treatments with the penetration-facilitating substance and polymeric substance, and the stiffening agent are performed on the cloth in the form of a solution. Besides, the number of steps varies according to the treating processes described above. Therefore, a suitable form may be selected according to the kind of cloth to be used, the kinds of the penetration-facilitating substance and polymeric substance, and the stiffening agent, the kinds of solvents dissolving these materials therein, and the like. Needless to say, the smoothing treatment of the cloth itself is required together with the drying in that the cloth is fed in a general-purpose ink-jet printer.

As with the ink-jet printing cloth stiffened in the above-described manner, the Clark stiffness is preferably not lower than 10, but not higher than 400 from the viewpoint of feeding.

According to other embodiments of the second aspect of the present invention, there are also provided an ink-jet printing process comprising printing on the ink-jet printing cloth according to the second aspect of the present invention as described above with inks each having an ionicity in accordance with an ink-jet system, and then washing the ink-jet printing cloth to remove the stiffening agent from the cloth, and a print produced in accordance with this ink-jet printing process.

After ink-jet printing is performed on the above-described ink-jet printing cloth, and the cloth is air-dried, the dyes are fixed and dyed within the cloth by the effect of the polymeric substance functioning as a dye-fixing agent. Therefore, unreacted penetration-facilitating substance and polymeric substance can be washed out by washing.

Further, since the stiffening agent is a substance soluble in water, it is removed at the same time by the above washing, and so the hand of the cloth returns to its original hand, thereby completing a bright print.

Incidentally, even in this aspect, the heating treatment may be conducted, and no limitation is imposed on washing like the description in the first aspect of the present invention.

Illustrative ink-jet printing apparatus which use the ink-jet printing cloths described above will hereinafter be described.

FIG. 1 shows an illustrative printing part of an industrial ink-jet printing apparatus in the present invention. An ink-jet printing process in which printing is performed on a large-sized cloth will be briefly described by reference to FIG. 1.

An ink-jet printing apparatus 1 roughly comprises a frame 6, two guide rails 7 and 8, an ink-jet head 9, a carriage 10 for moving the head, an ink supplying device 11, a carriage 12 for moving the ink supplying device, a head recovery device 13 and a transmitter 5. The ink-jet head 9 includes a plurality of nozzle lines and a converter for converting electric signals to ejection energy for ink and has a mechanism that inks are selectively ejected from the nozzle lines according to image signals sent from an image processing part (not shown).

As the ink-jet head, there is used an ink-jet head which makes good use of thermal energy to eject an ink therefrom and is equipped with a thermal energy converter for generating thermal energy to be applied to the ink, and in which the ink undergoes a change of state by the thermal energy applied by the thermal energy converter, so that the ink is ejected out of an orifice on the basis of this change of state.

The ink supplying device 11 serves to store an ink and supply a necessary amount of the ink to the ink-jet head, and has an ink tank and a pump for supplying the ink from the tank (hereinafter referred to as "ink-supplying pump" merely), which are not illustrated. The main body and the ink-jet head 9 are connected by an ink-supply tube 15, and usually, the ink is automatically fed to the ink-jet head 9 under a capillary action by an amount corresponding to an amount ejected from the ink-jet head. When the ink-jet head 9 is subjected to purging operation as described below, the ink is forcedly fed to the ink-jet head 9 by means of the ink-supplying pump.

The ink-jet head 9 and the ink supplying device 11 are mounted on the carriage 10 and the carriage 12, respectively, and are so constituted that they are reciprocatingly moved along the guide rails 7 and 8.

A recovery apparatus 13 for the ink-jet head is provided at a position opposite to the ink-jet head 9 situated at the home position (standby position) of the ink-jet head 9 for maintaining the ink-ejection stability of the ink-jet head 9, and is reciprocatingly movable in the directions indicated by arrows A. Specifically, the recovery apparatus 13 is operated as described below.

When the ink-jet head is not operated, the recovery apparatus 13 first caps the ink-jet head 9 at its home position (capping operation) to prevent the evaporation of the ink from the nozzles of the ink-jet head 9. Besides, the recovery apparatus 13 also serves to recover the ink discharged upon the operation (purging operation) of forcedly discharging the ink from the nozzles by pressurizing an ink flow path in the ink-jet head by the ink-feeding pump so as to discharge bubbles, dust and/or the like in the nozzles prior to the start of printing of images.

The transmitter 5 includes a control unit for conducting sequence control of a power supply part and the whole ink-jet printing part. A cloth 16 is moved in the secondary scanning direction (the direction indicated by an arrow B) by a predetermined length by a feeding device not illustrated every time the ink-jet head 9 is moved in the main scanning direction along the guide rails 7 and 8 to conduct printing by the predetermined length, thereby conducting the formation of an image. In the drawing, a diagonal portion 17 indicates a portion on which printing has been completed.

As the ink-jet head 9, there may be used an ink-jet head for single-color printing or a plurality of ink-jet heads capable of printing with inks of different colors.

Alternatively, any means such as an ink-jet unit of the cartridge type in which an ink-jet head and an ink tank are integrally formed, or a device so constituted that an ink-jet head and an ink tank are separated and connected by an ink-supplying tube may be applied to the ink-jet printing apparatus.

According to the system used in the present invention, in which an ink is ejected by using thermal energy, the high-density and high-definition printing can be achieved.

Figure 2:
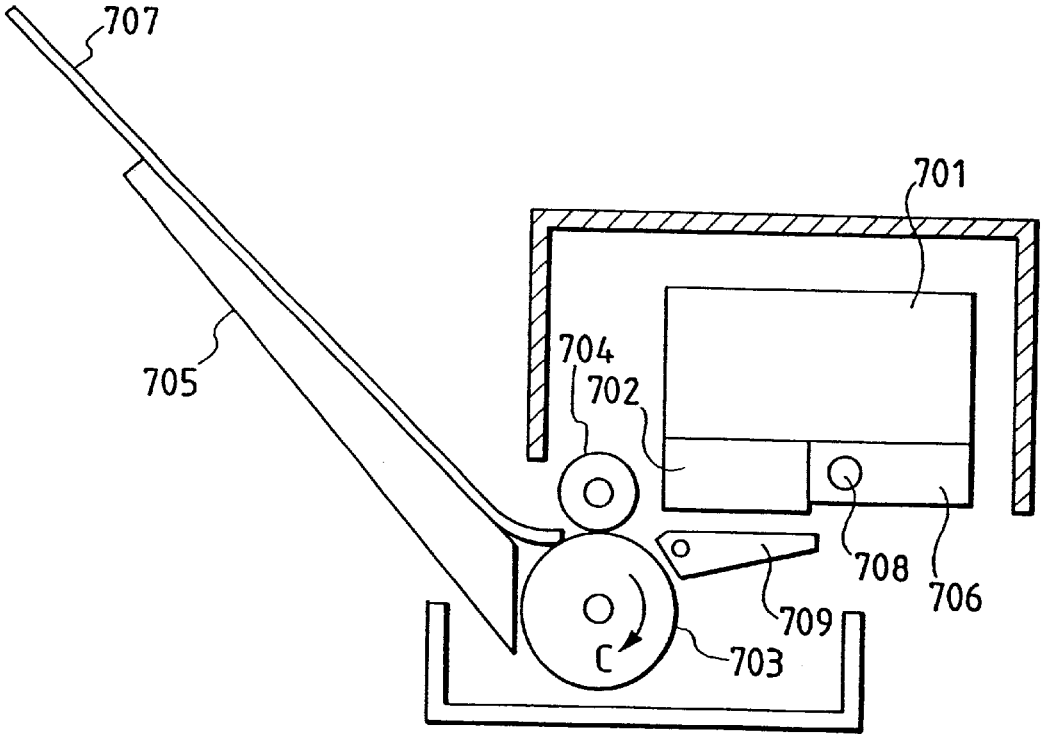
FIG. 2 illustrates the principal constitution of an ink-jet printing apparatus according to another embodiment of the present invention.

FIG. 2 shows principal parts of an ink-jet printing apparatus connected to the process according to the present invention for printing on a cloth by means of a general-purpose printer.

In this drawing, on a carriage 706, is mounted an integrated ink-jet cartridge 702 integrally comprising 4 ink tanks 701, in which 4 inks of black, cyan, magenta and yellow colors are respectively contained, and 4 ink-jet head units 174 (not shown) for respectively ejecting the four inks.

FIG. 2 illustrates how to automatically charge the ink-jet printing cloth in the form of a cut sheet (hereinafter may referred to as the "ink-jet printing cloth" merely) according to the present invention into the pair of feeding rollers. Many of the conventional ink-jet printing apparatus are of a system in which a member for pressing a printing medium against a cylindrical platen roller is released once to manually feed the printing medium, and the pressing member is then pressed, thereby bringing the printing medium into close contact with the platen roller to charge the printing medium. According to such a printing apparatus, little limitations are imposed on the stiffness of the printing medium and the like. It has been hence possible to feed even a cloth low in stiffness and make a print thereon. However, it has been difficult to align the grain of such a cloth with its feeding direction or twist and feed the cloth without wrinkling because of oblique motion or the like caused by the manual setting of the cloth. It has also been difficult to conduct ink-jet printing with high definition. Further, it has been difficult to stabilize the feedability due to the reduction in pressing force by repeated use of a releasing mechanism. Besides, the operatability of feed operation itself has become poor. Therefore, an apparatus by which automatic feeding can be achieved like this embodiment is preferred.

Referring further to FIG. 2, a feeder tray 705 is set obliquely for stably conducting automatic feeding. The feeder tray 705 is constituted so as to bring the leading end of the stiffened ink-jet printing cloth 707 into accurate contact with a drive roller 703 simply by inserting the printing cloth 707 along the feeder tray 705. In this state, the drive roller 703 is rotated on its axis, whereby the leading end of the stiffened ink-jet printing cloth 707 is accurately led to the press contact part between a pair of feeding rollers. Therefore, the ink-jet printing cloth 707 is automatically charged into the pair of feeding rollers as the feeding means without causing oblique motion and wrinkles.

In the preferred embodiment of the present invention, the ink-jet printing cloth has been cut along its grain as described above. Therefore, an image can be stably printed on the cloth in the direction of the predetermined grain, so that when the printed cloth is cut into pieces to use them in patchwork, the pattern of the print can be aligned with the grain of the cloth. Therefore, it is possible to make a high-quality work free from any strain. In the case where no feeder tray is provided, it is only necessary to adjust the leading end of the printing cloth to the press contact part between the driving and driven rollers and then to rotate the drive roller on its axis.

As described above, the ink-jet printing cloth in the form of a cut sheet according to the present invention has the same feeding property as plain paper. Besides the feeder tray, known register regulating mechanisms for paper feeding can also be applied to the ink-jet printing cloth.

The drive roller 703 rotates together with the driven roller 704 in the direction indicated by an arrow C in FIG. 2 while pressing the ink-jet printing cloth 707, thereby feeding the printing cloth upon occasion. The carriage 706 is constituted so as to stand by at its home position (not illustrated) when no printing is conducted or purging operation for a multi-head is conducted.

The carriage 706 situated at a position (home position) illustrated in FIG. 2 prior to the start of printing moves along a carriage guide rod 708 according to a printing start command, while the four color inks are ejected through respective multi-nozzles on the ink-jet head 174 according to a printing signal while being timed on the basis of a read signal from a linear encoder, thereby printing on the printing surface of the cloth by a width d. By this print scanning, the inks are impacted on the printing surface of the cloth in order of black, cyan, magenta and yellow inks to form dots. When printing based on the data is completed up to a side edge of the printing surface of the cloth, the carriage returns to its home position to conduct printing of the next line. The printing cloth is fed by a width d by rotating the drive roller 703 from the end of the first printing to the start of the second printing. In such a manner, printing and cloth feed by the printing width d of the ink-jet head are conducted every one scanning of the carriage, and this scanning is conducted repeatedly to complete data printing on the whole printing surface of the cloth.

At the time the printing is completed, the ink-jet printing cloth is discharged by the feeding means, and at the same time, the platen 709 which has formed a flat printing surface upon the printing is inclined in a discharging direction to a assist the discharge of the trailing end of the cloth. In order to assist the discharge and stably press the ink-jet printing cloth in, the printing part, means such as spur rollers may be provided on the downstream side of the printing part.

Figure 3:
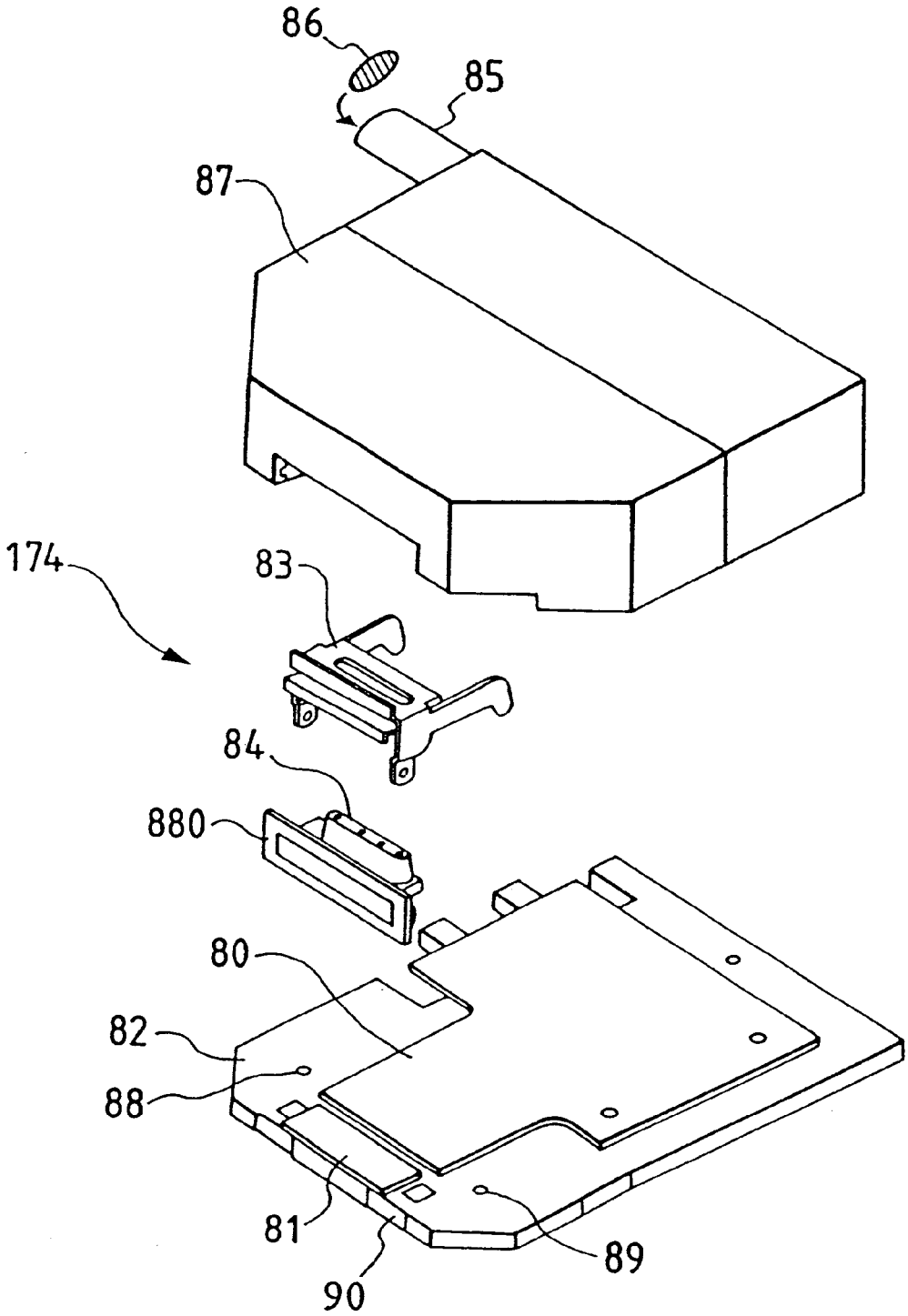
FIG. 3 illustrates the constitution of an ink-jet head applicable to the present invention.

FIG. 3 illustrates the constitution of the printing head 174 for ejecting ink, which is used in the apparatus according to the present invention.

An end of a circuit board 80 is connected to a wiring part of a heater board 81. On the other end of the circuit board 80, are provided plural pads corresponding to respective electrothermal energy converters for receiving electric signals from the main apparatus. By this constitution, the electric signals from the main apparatus are inputted to the respective electrothermal energy converters.

A metallic base plate 82 for supporting the back surface of the circuit board 80 on its plane serves as a bottom plate of an ink-jet unit. A pressure bar spring 83 includes a part formed by bending in substantially a U-shaped cross section so as to linearly spring-load a region in the vicinity of ink ejection orifices of a grooved top plate 84, claws hooked in relief holes bored in a base plate, and a pair of rear legs for receiving the force acted on the spring on the metallic base plate. By this spring force, the circuit board 80 is brought into contact under pressure with the top plate 84.

The attachment of the circuit board 80 to the base plate is made by sticking with an adhesive or the like. An ink-supplying pipe 85 has a filter 86 at its end. An ink-feeding member 87 is made by molding. In the grooved top plate 84, an orifice plate 880 and flow path, through which an ink is directed to each ink feed opening, are integrally formed. The ink-supplying member 87 is simply fixed to the base plate 82 by separately inserting two pins (not illustrated) provided on the back surface of the ink-supplying member 87 through two holes 88, 89 defined in the base plate 82 and then fusion-bond the pins in the holes. At this time, a gap between the orifice plate 880 and the ink-supplying member 87 is sealed. Further, a gap between the orifice plate 880 and a front end of the base plate 82 is completely sealed through grooves 90 provided in the base plate 82.

Figure 4:
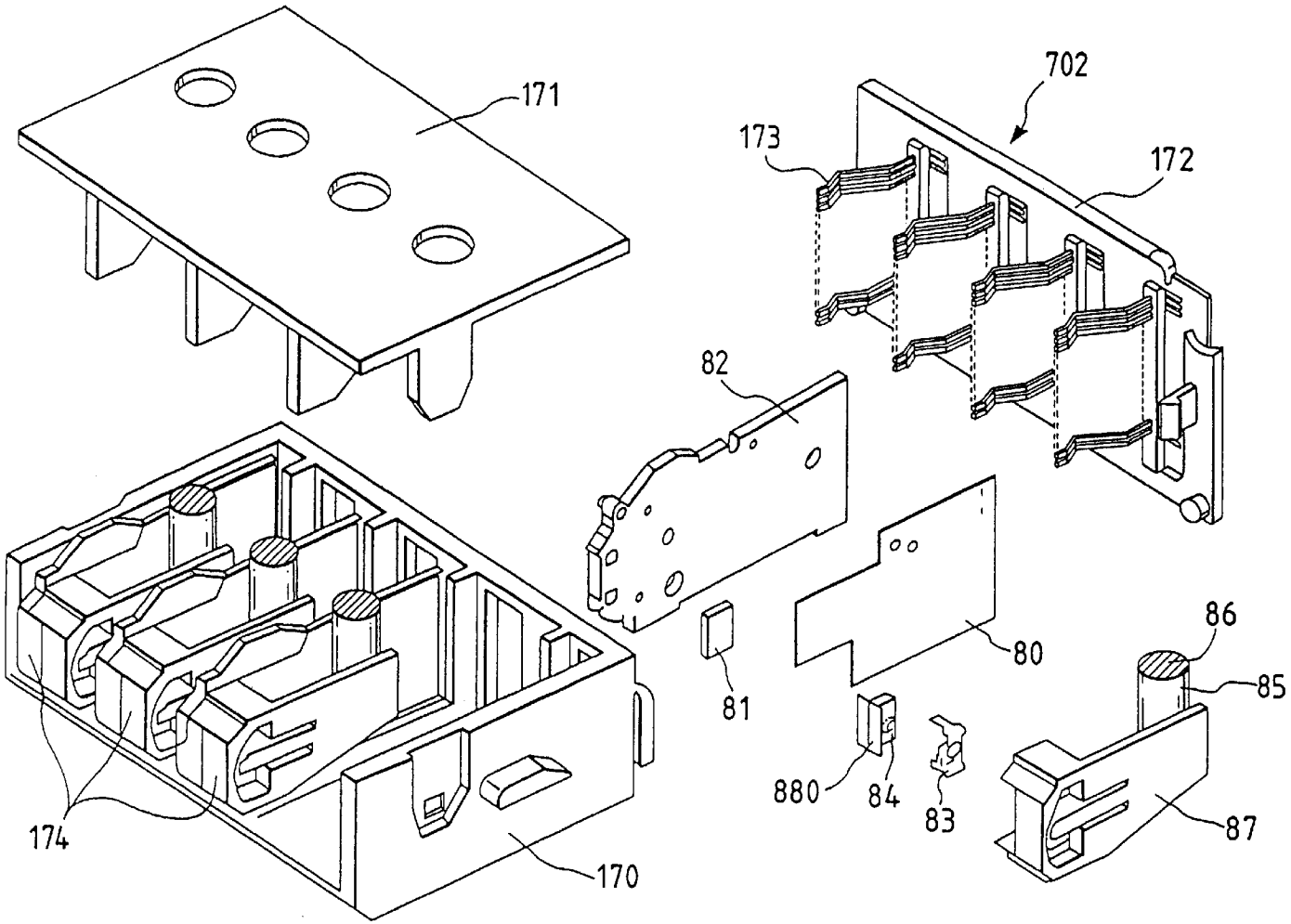
FIG. 4 illustrates the constitution of a color ink-jet head applicable to the present invention.

FIG. 4 illustrates the structure of the integrated ink-jet cartridge 702 obtained by integrally assembling the above-described four heads 174, which can respectively eject the four inks of black, cyan, magenta and yellow colors, in a frame 170. The four ink-jet heads are installed at predetermined intervals in the frame 170 and fixed in the state that the register in the direction of the nozzle line is aligned. In this embodiment, the alignment is conducted using the mechanical reference plane of the heads to enhance the precision of mutual impact positions among the colors. However, it is also permissible that the ink-jet heads are temporarily installed in the frame, the inks are actually ejected to measure impact positions, and mutual impact positions among the colors are directly regulated on the basis of the resulting measurement data, thereby further enhancing the precision.

Reference numeral 171 indicates a frame cover, and reference numeral 173 designates a connector for connecting each of the pads provided on the circuit boards 80 of the four ink-jet heads to an electric signal from the main body of the printing apparatus. The integral assembly of the four printing heads is useful in that there is an advantage from the viewpoint of handling, and besides, the precision of the mutual impact positions among the heads is enhance as described above. It also has a great effect in that the number of signal conductors to be connected to the main body of the printing apparatus can be decreased. For example, a signal conductor common to the four heads, such as a GND line can be made common on a connector base 172 to decrease the number of lines correspondingly. Besides, when an integrated circuit board is provided to conduct time-division driving every head, a printing signal conductor may also be made common. Such decrease in the number of electric connections is effective for apparatus making use of many signal conductors, such as color printing apparatus and multi-nozzle, high-speed printing apparatus.

By such constitution, operation of image printing is started according to image signals sent out of a personal computer (not shown) or the like connected to the ink-jet printing apparatus illustrated in FIG. 2, thereby conducting ink-jet printing.

The ink-jet printing cloths according to the present invention will hereinafter be described in detail on the basis of the following examples. Incidentally, the designation of "%" used in the following examples means % by weight unless otherwise noted.

EXAMPLE 1

A treating solution (a) having a composition shown below was first prepared.

| Treating solution (a): | |
|---|---|
| Benzalkonium chloride (cationic substance) | 2% |
| Polyallylamine hydrochloride (cationic polymeric substance, molecular weight: 10,000) | 5% |
| Water | 93%. |

A 100% cotton cloth in the form of piece goods was thoroughly dipped in this treating solution (a) and then squeezed to a pickup of 120% by a mangle, thereby conducting an impregnating treatment. The thus-treated cloth was then successively dried at 140° C. for 1 minute to obtain an ink-jet printing cloth in the form of piece goods. The total applied amount of the cationic substance and cationic polymeric substance in the thus-obtained cloth was 7.0 g/m$^2$.

Here, the pickup is defined by the equation $$\text{Pickup } (\%)=(W2-W1)/W1)\times 100$$

wherein W1 and W2 are weights of the cloth before and after the impregnating treatment, respectively.

Four inks (A) to (D) (corresponding to black, cyan, magenta and yellow inks, respectively) described below were charged in separate ink tanks, and these tanks were mounted in the ink-jet printing apparatus illustrated in FIG. 1. The respective inks were each obtained by mixing its corresponding all components, stirring the mixture for 2 hours, followed by pressure filtration through a "Fluoropore Filter FP-100" (trade name; product of Sumitomo Electric Industries, Ltd.).

| Ink (A): | |
|---|---|
| C.I. Food Black 2 | 3% |
| Thiodiglycol | 10% |
| Ethylene oxide adduct of acetylene glycol | 0.05% |
| Water | Balance. |
| **Ink (B):** | |
| C.I. Acid Blue 9 | 2.5% |
| Thiodiglycol | 10% |

-continued

| | |
|---|---|
| Ethylene oxide adduct of acetylene glycol | 0.05% |
| Water | Balance. |
| Ink (C): | |
| C.I. Acid Red 289 | 2.5% |
| Thiodiglycol | 10% |
| Ethylene oxide adduct of acetylene glycol | 0.05% |
| Water | Balance. |
| Ink (D): | |
| C.I. Direct Yellow 86 | 2% |
| Thiodiglycol | 10% |
| Ethylene oxide adduct of acetylene glycol | 0.05% |
| Water | Balance. |

Using these ink-jet printing cloth and Inks (A) to (D), printing was performed on the cloth at a resolution of 360 dpi by the ink-jet printing apparatus illustrated in FIG. 1. A print thus obtained was very bright, good in image reproducibility per unit dot and underwent no bleeding attributable to unnecessary mixing of different colors even at portions at which the different colors adjoined.

After completion of the printing process, the printed cloth was washed with running water. As a result, the cloth held dye well and hence had a sufficient color-fixing effect.

EXAMPLE 2

After coating the ink-jet printing cloth prepared in Example 1 with the following treating solution (b) as a stiffening agent by a roll coater, the thus-treated cloth was dried at 80° C. for 2 minutes and further pressed by hot press plates controlled at 100° C. to conduct a smoothing treatment. The thus-smoothed cloth was then cut by a slitter into A4-sized cut sheets along the direction of the grain of the cloth, thereby providing cut sheets of the stiffened ink-jet printing cloth.

| Treating solution (b): | |
|---|---|
| Nonionic carboxymethylcellulose | 7% |
| Water | 93%. |

The thus-obtained cut sheets of the ink-jet printing cloth were set in the ink-jet printing apparatus illustrated in FIG. 2 to conduct printing.

The printed image thus obtained was bright and underwent no unnecessary bleeding. Thereafter, this printed cloth was washed for 7 minutes with tap water by a household washing machine, whereby the stiffening agent was able to be removed with ease. After completion of the water washing, the cloth was treated 1 minute by a hydro-extractor. During the washing process, washing water was clear to the end. Besides, the bright image on the cloth underwent no changes in color depth and saturation. Sufficient heat was applied to the surface of the thus-washed cloth by a household iron to smooth wrinkles of the cloth, thereby obtained a desired print.

EXAMPLE 3

After the cut sheets of the stiffened ink-jet printing cloth obtained in Example 2. were left to stand for 48 hours together with the ink-jet printing apparatus illustrated in FIG. 2 under a high-humidity environment (30° C., 80% RH), the same printing operation as in Example 2 was conducted. Even in this case, the printed image thus obtained underwent no unnecessary bleeding and was bright, to say nothing of good feeding of the cloth in the printing apparatus.

Thereafter, the printed cloth was immersed in 5 liters of water, scrubbed with hands for 5 minutes, and dried and ironed in the same manner as in Example 2. As a result, the stiffening agent was completely removed, but no dyes were run out, thereby obtaining a print having the original hand of 100% cotton.

EXAMPLE 4

A treating solution (c) having a composition shown below was prepared.

| Treating solution (c): | |
|---|---|
| Benzyltrimethylammonium chloride (cationic substance) | 3% |
| Polyallyl sulfone (cationic polymeric substance, molecular weight: 100,000) | 3% |
| Water | 94%. |

A silk cloth in the form of piece goods was thoroughly dipped in this treating solution (c) and then squeezed to a pickup of 110% by a mangle, thereby conducting an impregnating treatment. The thus-treated cloth was then successively dried at 140° C. for 1 minute to obtain an ink-jet printing cloth in the form of piece goods. The total applied amount of the cationic substance and cationic polymeric substance in the thus-obtained cloth was 10 g/m$^2$.

The ink-jet printing cloth thus obtained was set in the ink-jet printing apparatus described in Example 1, whereby printing was performed on the cloth at a resolution of 360 dpi. A print thus obtained was very bright, good in image reproducibility per unit dot and underwent no bleeding attributable to unnecessary mixing of different colors even at portions at which the different colors adjoined. After completion of the printing process, the printed cloth was washed with hot water of 50° C. As a result, no reduction of color depth was observed on the resulting image, and the cloth was able to provide a more brightly colored image and had a sufficient color-fixing effect.

EXAMPLE 5

A treating solution (d) having a composition shown below, in which a component of a stiffening agent was contained together with a cationic substance and a cationic polymeric substance, was prepared.

| Treating solution (d): | |
|---|---|
| Benzalkonium chloride (cationic substance) | 1.5% |
| Polyallylamine hydrochloride (cationic polymeric substance, molecular weight: 80,000) | 4% |
| Guar gum (nonionic stiffening agent) | 5% |
| Water | 89.5%. |

A silk cloth in the form of piece goods was thoroughly dipped in this treating solution (d) and then squeezed to a pickup of 110% by a mangle, thereby conducting an impregnating treatment. The thus-treated cloth was then successively dried at140° C. for 1 minute to obtain an ink-jet printing cloth in the form of piece goods. The total applied amount of the cationic substance and cationic polymeric substance in the thus-obtained cloth was 5 g/m$^2$.

This ink-jet printing cloth was able to set in the feeding means of the ink-jet printing apparatus described in Example 2 because the cloth was impregnated with the stiffening agent from the first. Therefore, the ink-jet printing cloth was cut into A4-sized cut sheets, and 20 sheets thereof were set in the feeding means in a stacked state, followed by continuous printing on 20 cut sheets of the ink-jet printing cloth. All the images obtained on the cloths were bright, kept sufficient color depth and underwent no unnecessary bleeding. In addition, since the stiffening agent was nonionic, it was not ionically bonded to any dye in the inks. Therefore, the printed cloths held dye well even when they were subsequently washed. Further, even when these feeding and printing tests were performed in the same manner as described above under an environment of 30° C. and 80% RH, problems such as feeding failure, disorder of images and washing-out of color did not arise.

EXAMPLE 6

| Treating solution (e): | |
|---|---|
| Adduct of nonylphenol with 10 Moles of ethylene oxide (nonionic surfactant, H.L.B.: 13.3) | 3% |
| Polyallylamine hydrochloride (cationic polymeric substance, molecular weight: 100,000) | 5% |
| Water | 92%. |

A 100% cotton cloth in the form of piece goods was thoroughly dipped in this treating solution (e) and then squeezed to a pickup of 60% by a mangle, thereby conducting an impregnating treatment. The thus-treated cloth was then successively dried at 140° C. for 1 minute to obtain an ink-jet printing cloth in the form of piece goods. The total applied amount of the nonionic surfactant and cationic polymeric substance in the thus-obtained cloth was 7.0 g/m$^2$.

This ink-jet printing cloth was cut into A4-sized cut sheets, and each of them was stuck on an A4-sized paper sheet. The thus-obtained laminate sheet was set in the ink-jet printing apparatus illustrated in FIG. 2 to conduct printing.

The thus-obtained print was very bright in color, sufficient in the penetration of the inks into the interior of the cloth and also good in evenness of a solid printed area. Besides, the print underwent no bleeding attributable to unnecessary mixing of different colors even at portions at which the different colors adjoined. In particular, no bleeding occurred even at color-mixed areas such as R (Red), G (Green) and B (Blue) formed by mixing two of the above-described inks, i.e., portions to which a great amount of the inks was applied. Even when the cloth after the printing was washed with running water, the cloth held dye well and hence had a sufficient color-fixing effect.

After the cut sheets of the ink-jet printing cloth thus obtained were left to stand for 48 hours together with the ink-jet printing apparatus illustrated in FIG. 2 under a high-humidity environment (30° C., 80% RH), the same printing operation as described above was conducted. Even in this case, problems such as disorder of images, washing-out of color and contamination of waste water did not arise.

EXAMPLE 7

After coating the ink-jet printing cloth prepared in Example 6 with the following treating solution (f) as a stiffening agent by a roll coater, the thus-treated cloth was dried at 120° C. for 2 minutes and further pressed by hot press plates controlled at 100° C. to conduct a smoothing treatment. The thus-smoothed cloth was then cut by a slitter into A4-sized cut sheets along the direction of the grain of the cloth, thereby providing cut sheets of the stiffened ink-jet printing cloth. The cut sheets of the ink-jet printing cloth thus obtained had a Clark stiffness of 40.

| Treating solution (f): | |
|---|---|
| Guar gum | 3% |
| Water | 97%. |

The thus-obtained cut sheets of the ink-jet printing cloth were set in the ink-jet printing apparatus illustrated in FIG. 2 to conduct printing. These cut sheets of the ink-jet printing cloth were able to set in the ink-jet printing apparatus as they are because they had been subjected to the stiffening treatment. Therefore, 20 sheets thereof were set in the feeding means in a stacked state, and printing was continuously conducted on 20 sheets of the ink-jet printing cloth. Feeding of the cloth in the printing apparatus was good, and prints were hence able to be obtained very simply by the general-purpose ink-jet printing apparatus.

Each of the thus-obtained prints was very bright in color, sufficient in the penetration of the inks into the interior of the cloth and also good in evenness of a solid printed area. Besides, the print underwent no bleeding attributable to unnecessary mixing of different colors even at portions at which the different colors adjoined. In particular, no bleeding occurred even at color-mixed areas such as R, G and B, i.e., portions to which a great amount of the inks was applied. Thereafter, this printed cloth was washed for 7 minutes with tap water by a household washing machine, whereby the stiffening agent was able to be removed with ease to obtain a print having hand of 100% cotton. No reduction of color depth due to the washing occurred, and washing water was also clear. Besides, the image underwent no changes even in color depth and saturation. The overall surface of the printed cloth was sufficiently heated by a household iron to smooth wrinkles of the cloth, thereby obtained a desired print.

Further, the cut sheets of the ink-jet printing cloth thus obtained were left to stand together with the ink-jet printing apparatus under a high-humidity environment in the same manner as in Example 6, and printing was then conducted in this environment. Even in this case, problems such as feeding failure, disorder of images and washing-out of color did not arise.

EXAMPLE 8

A treating solution (g) having a composition shown below was prepared.

| Treating solution (g): | |
|---|---|
| Adduct of lauryl alcohol with 5 moles of ethylene oxide (nonionic surfactant, H.L.B.: 10.8) | 4% |

-continued

| Treating solution (g): | |
|---|---|
| Polydiallyldimethylammonium chloride (cationic polymer, molecular weight: 100,000) | 6% |
| Water | 90%. |

A 100% silk cloth in the form of piece goods was thoroughly dipped in this treating solution (g) and then squeezed to a pickup of 80% by a mangle, thereby conducting an impregnating treatment. The thus-treated cloth was then successively dried at 90° C. for 2 minutes to obtain an ink-jet printing cloth in the form of piece goods. The total applied amount of the nonionic surfactant and cationic polymeric substance in the thus-obtained cloth was 7.0 g/m$^2$. This ink-jet printing cloth was cut into A4-sized cut sheets, and each of them was stuck on an A4-sized film made of polyethylene terephthalate, followed by printing under ordinary temperature and humidity, and under high humidity in the same manner as in Example 6.

In each environment, the thus-obtained print was very bright in color, sufficient in the penetration of the inks into the interior of the cloth and also good in evenness of a solid printed area. Besides, the print underwent no bleeding attributable to unnecessary mixing of different colors even at portions at which the different colors adjoined. In particular, no bleeding occurred even at color-mixed areas such as R, G and B formed by mixing two of the above-described inks, i.e., portions to which a great amount of the inks was applied. Thereafter, the printed cloth was rumplingly rinsed with hands in 5 liters of warm water. As a result, no reduction of color occurred, and washing water was clear. Besides, the image underwent no changes even in color depth and saturation.

EXAMPLE 9

The ink-jet printing cloth prepared in Example 8 was fully dipped in the following treating solution (h) as a stiffening agent and then squeezed to a pickup of 60% by a mangle, thereby conducting an impregnating treatment. The thus-treated cloth was then successively dried at 80° C. for 2 minutes to obtain an ink-jet printing cloth in the form of piece goods. At this time, the applied amount of the treating solution in the thus-obtained cloth was 7.0 g/m$^2$. The thus-treated cloth was then cut by a slitter into A4-sized cut sheets along the direction of the grain of the cloth, thereby providing cut sheets of the stiffened ink-jet printing cloth. The cut sheets of the ink-jet printing cloth thus obtained had a Clark stiffness of 40.

| Treating solution (h): | |
|---|---|
| Polyacrylamide | 6% |
| Water | 94%. |

These cut sheets of the ink-jet printing cloth were able to set in the ink-jet printing apparatus shown in FIG. 2 as they are because they had been subjected to the stiffening treatment. Therefore, 20 sheets thereof were set in the feeding means in a stacked state, and printing was continuously conducted on 20 cut sheets of the ink-jet printing cloth under ordinary temperature and humidity, and in a high-humidity environment in the same manner as in Example 7. As a result, even in each environment, feeding of the cloth in the printing apparatus was good, and prints were hence able to be obtained very simply by the general-purpose ink-jet recording apparatus.

Each of the thus-obtained prints was very bright in color, sufficient in the penetration of the inks into the interior of the cloth and also good in evenness of a solid printed area. Besides, the print underwent no bleeding attributable to unnecessary mixing of different colors even at portions at which the different colors adjoined. In particular, no bleeding occurred even at color-mixed areas such as R, G and B, i.e., portions to which a great amount of the inks was applied.

Thereafter, this printed cloth was rumplingly rinsed softly with hands for 5 minutes in running water, whereby the stiffening agent was able to be removed with ease to obtain a print having hand of 100% silk. Neither disorder of image nor washing-out of color was caused by the washing treatment.

EXAMPLE 10

A treating solution (i) having a composition shown below, in which a component of a stiffening agent was contained together with a nonionic surfactant and a cationic polymeric substance, was prepared.

| Treating solution (i): | |
|---|---|
| Adduct of nonylphenol with 10 moles of ethylene oxide (nonionic surfactant, H.L.B.: 13.3) | 2% |
| Diallylamine-acrylamide copolymer (cationic polymeric substance, molecular weight: 80,000) | 3% |
| Guar gum (nonionic stiffening agent) | 5% |
| Water | 90%. |

A 100% cotton cloth in the form of piece goods was thoroughly dipped in this treating solution (i) and then squeezed to a pickup of 80% by a mangle, thereby conducting an impregnating treatment. The thus-treated cloth was then successively dried at 140° C. for 1 minute to obtain an ink-jet printing cloth in the form of piece goods. The applied amount of the treating solution in the thus-obtained cloth was 9.0 g/m$^2$.

This ink-jet printing cloth was able to set in the feeding means of the ink-jet printing apparatus shown in FIG. 2 as it is because the stiffening agent was applied from the first. Therefore, 20 cut sheets thereof were set in the feeding means in a stacked state, and printing was continuously conducted on 20 cut sheets of the ink-jet printing cloth under ordinary temperature and humidity, and in a high-humidity environment in the same manner as in Example 7. As a result, even in each environment, feeding of the cloth in the printing apparatus was good, and prints were hence able to be obtained very simply by the general-purpose ink-jet recording apparatus. All the images were bright, kept sufficient color depth and underwent no unnecessary bleeding.

Thereafter, each of these printed cloths was washed for 7 minutes with tap water by a household washing machine, whereby the stiffening agent was able to be removed with ease to obtain a print having hand of 100% cotton. Since the stiffening agent was nonionic, it was not ionically bonded to any dye in the inks. Therefore, the printed cloth held dye well, and the image underwent no changes even in color depth and saturation even when it was washed. The overall surface of the printed cloth was sufficiently heated by a household iron to smooth wrinkles of the cloth, thereby obtained a desired print.

REFERENTIAL EXAMPLE

A treating solution (j) having a composition shown below was prepared.

| Treating solution (j): | |
|---|---|
| Polyallylamine (cationic polymeric substance, molecular weight: 100,000) | 3% |
| Water | 97%. |

Using this treating solution (j), A4-sized cut sheets of an ink-jet printing cloth were produced in the same manner as in Example 6, and printing was conducted under ordinary temperature and humidity, and high-humidity in the same manner as in Example 6. Among the thus-obtained prints, those obtained by printing under the ordinary temperature and humidity underwent bleeding at color-mixed areas such as R, G and B, i.e., portions at which the amounts of the inks were great, and different colors adjoined, and were also dull in color. Those obtained by printing under the high-humidity underwent bleeding at portions at which Y (Yellow), M (Magenta) and C (Cyan) adjoined, and were also poor in evenness of a solid printed area. Thereafter, they were scrubbed with hands in 5 liters of hot water of 50° C. As a result, water became turbid, and reduction of color depth was observed at color-mixed areas.

In the examples described above, the cloths were treated with various forms. In each form, the bright image always remained unchanged after water washing, and the color of the image was not washed out at all.

In the ink-jet printing apparatus capable of setting the various kinds of printing cloths described in the examples, the shot-in ink quantity can be controlled and selected according to the thickness and material of the cloth.

When printing is conducted on plain paper, the maximum shot-in ink quantity is limited from the viewpoints of reduction in resolution, bleeding between different colors, strike through, increase in fixing time and the like. Therefore, the ink-jet printing apparatus are generally designed in such a manner that the maximum shot-in ink quantity is regulated to usually 16 to 28 nl/mm$^2$ or so if water-based inks are used.

However, when printing is conducted on cloths, a greater amount of the inks may be received in some cases. Therefore, these embodiments make it possible to increase the shot-in ink quantity, as needed, by conducting high-density printing at a speed lower than a scanning speed corresponding to the drive frequency of an ink-jet head, for example, double-density printing at half scanning speed, performing overlapping printing by scanning plural times in the same printing region, controlling the drive of an ink-jet head to increase the amount of ink to eject, for example, raising the lagging temperature in a thermal ink-jet head, and/or conducting multi-pulse drive.

According to the present invention, as described above, there is obtained an ink-jet printing cloth suitable for use in printing with inks each containing a dye having an ionicity, which can provide printed images always undergoing no unnecessary bleeding and being free from washing-out of color even when the printed cloth is washed as it is after ink-jet printing, even under any conditions, wherein a penetration-facilitating substance not having the same ionicity as that of the dye and a polymeric substance having an ionicity opposite to that of the dye are applied to the cloth.

When a stiffening agent is further applied to such a cloth, the stiffness of the cloth can be enhanced to improve its feeding property. Therefore, printing can be easily conducted on such a cloth even by a general-purpose ink-jet printer, and so the cloth can be applied to not only an industrial field, but also a field of printing for pleasure in general homes.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An ink-jet printing process using an ink containing a dye having an ionicity, comprising the steps of:

providing a cloth containing (a) a substance having an ionicity opposite to that of the dye and a molecular weight of from 100 to 700, or a nonionic surfactant having a molecular weight of from 100 to 700 and an H.L.B. of from 7 to 15, and (b) a polymeric substance having an ionicity opposite to that of the dye and a molecular weight of from 2,000 to 200,000;

printing on the cloth with the ink in accordance with an ink-jet system;

washing the cloth after the printing; and drying the cloth.

2. The ink-jet printing process according to claim 1, wherein a weight ratio of the substance (a) to the polymeric substance (b) is in a range of from 1:100 to 1:1.

3. The ink-jet printing process according to claim 1, wherein a weight ratio of the substance (a) to the polymeric substance (b) is in a range of from 1:10 to 1:1.

4. The ink-jet printing process according to claim 1, wherein the total amount of the substances (a) and (b) applied to the cloth is in a range of from 0.05 g/m$^2$ to 20 g/m$^2$.

5. The ink-jet printing process according to claim 1, wherein a weight ratio of the nonionic surfactant (a) to the polymeric substance (b) is in a range of from 1:10 to 10:1.

6. The ink-jet printing process according to claim 1, wherein a weight ratio of the nonionic surfactant (a) to the polymeric substance (b) is in a range of from 1:10 to 1:1.

7. The ink-jet printing process according to claim 1, wherein the total amount of the nonionic surfactant (a) and the polymeric substance (b) applied to the cloth is in a range of from 0.05 g/m$^2$ to 20 g/m$^2$.

8. The ink-jet printing process according to claim 1, wherein the total amount of the nonionic surfactant (a) and the polymeric substance (b) applied to the cloth is in a range of from 1 g/m$^2$ to 10 g/m$^2$.

9. The ink-jet printing process according to claim 1, wherein the dye is anionic and both the substance (a) and the polymeric substance (b) are cationic.

10. The ink-jet printing process according to claim 9, wherein the substance (a) is a material selected from the group consisting of lauryltrimethylammonium chloride, lauryldimethylbenzylammonium chloride, benzyltributylammonium chloride, benzalkonium chloride, cetylpyridinium chloride, cetylpyridinium bromide, 2-heptadecenyl hydroxyethylimidazoline and dihydroxyethylstearylamine.

11. The ink-jet printing process according to claim 9, wherein the polymeric substance (b) is a material selected from the group consisting of polyallylamine salt, polyallysulfone, polydimethyldiallylammonium chloride, polyvinylamine salt and chitosan acetate.

12. The ink-jet printing process according to claim 1, wherein the ink is ejected from an orifice of a printing head by applying thermal energy to the ink.

13. The ink-jet printing process according to claim 1, wherein the cloth is subjected to a heat treatment after the step of printing.

14. An ink-jet printing process using an ink containing a dye having an ionicity, comprising the steps of:

providing a cloth containing (a) a substance having an ionicity opposite to that of the dye and a molecular weight of from 100 to 700, or a nonionic surfactant having a molecular weight of from 100 to 700 and an H.L.B. of from 7 to 15, (b) a polymeric substance having an ionicity opposite to that of the dye and a molecular weight of from 2,000 to 200,000 and (c) a stiffening agent which is not chemically and physically bonded to the dye;

printing on the cloth with the ink in accordance with an ink-jet system; and washing the cloth after the printing to remove the stiffening agent from the cloth; and drying the cloth.

15. The ink-jet printing process according to claim 1, wherein the total amount of the substances (a) and (b) applied to the cloth is in a range of from 1 $g/m^2$ to 10 $g/m^2$.

16. The ink-jet printing process according to claim 14, wherein a weight ratio of the substance (a) to the polymeric substance (b) is in a range of from 1:100 to 1:1.

17. The ink-jet printing process according to claim 14, wherein a weight ratio of the substance (a) to the polymeric substance (b) is in a range of from 1:10 to 1:1.

18. The ink-jet printing process according to claim 14, wherein the total amount of the substances (a) and (b) applied to the cloth is in a range of from 0.05 $g/m^2$ to 20 $g/m^2$.

19. The ink-jet printing process according to claim 14, wherein the total amount of the substances (a) and (b) applied to the cloth is in a range of from 1 $g/m^2$ to 10 $g/m^2$.

20. The ink-jet printing process according to claim 14, wherein a weight ratio of the nonionic surfactant (a) to the polymeric substance (b) is in a range of from 1:10 to 10:1.

21. The ink-jet printing process according to claim 14, wherein a weight ratio of the nonionic surfactant (a) to the polymeric substance (b) is in a range of from 1:10 to 1:1.

22. The ink-jet printing process according to claim 14, wherein the total amount of the nonionic surfactant (a) and the polymeric substance (b) applied to the cloth is in a range of from 0.05 $g/m^2$ to 20 $g/m^2$.

23. The ink-jet printing process according to claim 14, wherein the total amount of the nonionic surfactant (a) and the polymeric substance (b) applied to the cloth is in a range of from 1 $g/m^2$ to 10 $g/m^2$.

24. The ink-jet printing process according to claim 14, wherein the dye is anionic and both the substance (a) and the polymeric substance (b) are cationic.

25. The ink-jet printing process according to claim 24, wherein the substance (a) is a material selected from the group consisting of lauryltrimethylammonium chloride, lauryldimethylbenzylammonium chloride, benzyltributylammonium chloride, benzalkonium chloride, cetylpyridinium chloride, cetylpyridinium bromide, 2-heptadecenyl hydroxyethylimidazoline and dihydroxyethylstearylamine.

26. The ink-jet printing process according to claim 24, wherein the polymeric substance (b) is a material selected from the group consisting of polyallylamine salt, polyallysulfone, polydimethyldiallyammonium chloride, polyvinylamine salt and chitosan acetate.

27. The ink-jet printing process according to claim 14, wherein the stiffening agent is a material selected from the group consisting of carboxymethyl cellulose, polyvinyl alcohol, polyacrylate, polyacrylamide, starch, dextrin, guar gum, tragacanth gum and locust bean gum.

28. The ink-jet printing process according to claim 14, wherein the stiffening agent is nonionic.

29. The ink-jet printing process according to claim 14, wherein the ink is ejected from an orifice of a printing head by applying thermal energy to the ink.

30. The ink-jet printing process according to claim 14, wherein the cloth is subjected to a heat treatment after the step of printing.

31. An ink-jet printing process using an ink containing a dye having an ionicity, comprising the steps of:

(i) providing a cloth having a Clark stiffness of from 10 to 400, and containing (a) a substance having an ionicity opposite to that of the dye and a molecular weight of from 100 to 700, or a nonionic surfactant having a molecular weight of from 100 to 700 and an H.L.B of from 7 to 15, (b) a polymeric substance having an ionicity opposite to that of the dye and a molecular weight of from 2,000 to 200,000, and (c) a stiffening agent which is not chemically and physically bonded to the dye, the stiffening agent being contained so that the cloth has a Clark stiffness of from 10 to 400 when the cloth is dried;

(ii) printing on the cloth with the ink in accordance with an ink-jet system;

(iii) washing the cloth resulting from step (ii); and (iv) drying the cloth resulting from step (iii).

32. The ink-jet printing process according to claim 31, wherein step (iv) comprises an air-drying step.

* * * * *

UNITED STATES PATENT AND TRADEMARK OFFICE

CERTIFICATE OF CORRECTION

PATENT NO. : 6,325,501 B2
DATED : December 4, 2001
INVENTOR(S) : Nobuyuki Kuwabara et al.

It is certified that error appears in the above-identified patent and that said Letters Patent is hereby corrected as shown below:

Column 2,
Line 29, "is intended to provide" should read -- are intended to be provided --.

Column 4,
Line 24, "more penetrate in" should read -- penetrate further into --.

Column 8,
Line 56, "the" should read -- into the --.

Column 13,
Line 62, "enhance" should read -- enhanced --.

Column 14,
Line 51, "its" should read -- all of its --.
Line 52, "all" should be deleted.

Column 15,
Line 60, "obtained" should read -- obtaining --.

Column 18,
Line 46, "obtained" should read -- obtaining --.

Column 21,
Line 2, "obtained" should read -- obtaining --.

Signed and Sealed this

Sixth Day of May, 2003

JAMES E. ROGAN
*Director of the United States Patent and Trademark Office*